US006354698B1

(12) United States Patent
Tachihara et al.

(10) Patent No.: US 6,354,698 B1
(45) Date of Patent: Mar. 12, 2002

(54) LIQUID EJECTION METHOD

(75) Inventors: Masayoshi Tachihara, Chofu; Mineo Kaneko, Tokyo, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/220,688

(22) Filed: Dec. 23, 1998

(30) Foreign Application Priority Data

Dec. 26, 1997 (JP) ..... 9-361430

(51) Int. Cl.[7] ..... B41J 2/05
(52) U.S. Cl. ..... 347/56; 347/61
(58) Field of Search ..... 347/56, 54, 65, 347/61, 45, 47

(56) References Cited

U.S. PATENT DOCUMENTS

| | | | | |
|---|---|---|---|---|
| 4,410,899 A | | 10/1983 | Haruta et al. | 347/56 |
| 4,638,337 A | | 1/1987 | Torpey et al. | 347/65 |
| 4,723,129 A | | 2/1988 | Endo et al. | 347/56 |
| 4,740,796 A | | 4/1988 | Endo et al. | 347/56 |
| 5,754,202 A | * | 5/1998 | Sekiya et al. | 347/63 |

FOREIGN PATENT DOCUMENTS

| | | | |
|---|---|---|---|
| DE | 42 23 707 | 1/1993 | |
| DE | 195 05 465 | 8/1995 | |
| EP | 0 641 654 | 3/1995 | |
| EP | 0 654 353 | 5/1995 | |
| EP | 0 641 654 A2 * | 8/1995 | B41J/2/05 |
| GB | 2 106 039 | 4/1983 | |
| JP | 54-161935 | 12/1979 | |
| JP | 60-161973 | 8/1985 | |
| JP | 63-221121 | 9/1988 | |
| JP | 01-9216 | 1/1989 | |
| JP | 2-140219 | 5/1990 | |
| JP | 4-10940 | 1/1992 | |
| JP | 4-10941 | 1/1992 | |
| JP | 4-10942 | 1/1992 | |
| JP | 4-12859 | 1/1992 | |
| JP | 5-116299 | 5/1993 | |

OTHER PUBLICATIONS

Crivello et al., "New Photoinitiators for Cationic Polymerization", *Journal of Polymer Science*, pp. 383–395, 1997.

* cited by examiner

*Primary Examiner*—John Barlow
*Assistant Examiner*—Blaise Mouttet
(74) *Attorney, Agent, or Firm*—Fitzpatrick, Cella, Harper & Scinto

(57) ABSTRACT

A liquid ejection method includes a step of preparing a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on its bottom side; and a step of applying the thermal energy to the liquid to cause the liquid to undergo a change of state and thus to create a bubble. The liquid is ejected through the ejection outlet by the pressure of the bubble. The bubble is first in communication with ambience during reduction of the volume of the bubble after the bubble reaches a maximum volume.

24 Claims, 7 Drawing Sheets

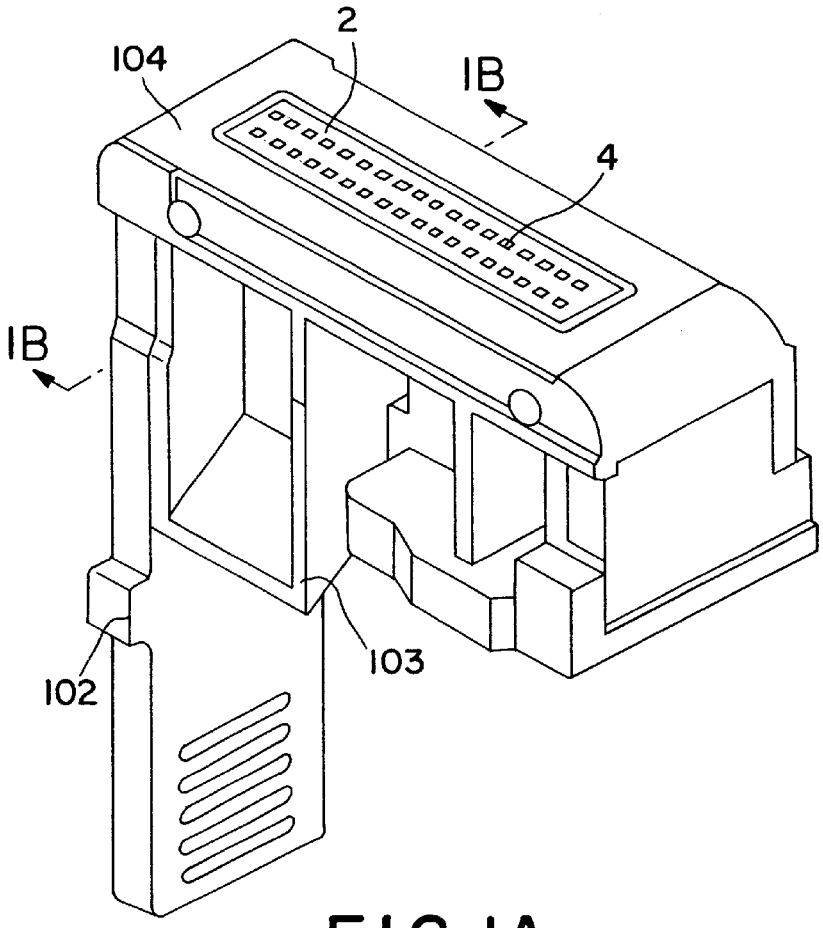
FIG. IA
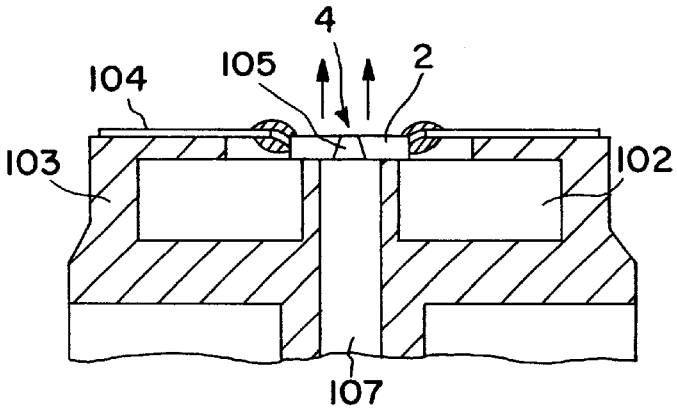
FIG. IB

LIQUID EJECTION METHOD

FIELD OF THE INVENTION AND RELATED ART

The present invention relates to a method for ejecting liquid droplets onto various media, such as a sheet of paper, to record images on the medium. In particular, it relates to a method for ejecting extremely fine liquid droplets.

There are various recording methods which have been put to practical use in various printers or similar apparatuses. Among them, the recording methods which employ the ink jet systems disclosed in the specifications of U.S. Pat. No. 4,723,129, and 4,740,796 are very effective. According to these patents, thermal energy is used to cause so-called "film boiling", and the bubbles generated by the "film-boiling" are used for ejecting liquid in the form of droplets.

Among the ink jet based recording methods, the one disclosed in the specification of U.S. Pat. No. 4,410,899 has been known as an ink jet system based recording method of a sort that does not block a liquid path while forming a bubble.

The inventions disclosed in the above documents are applicable to various recording apparatuses. However, there is no record that a recording system which allows a bubble that is formed in an ink path to eject liquid, to become connected to the atmospheric air (hereinafter, "bubble-atmospheric air connection system" or simply, "bubble-air connection system"), has been developed enough to be put to practical use.

The conventional "bubble-air integration systems" rely on bubble explosion, but they are not stable in terms of liquid ejection. Therefore, they cannot be put to practical use. However, there is a promising system, which is disclosed in Japanese Laid-Open Patent Application No. 161935/1979. The liquid ejection principle in this system is unclear. According to this system, a cylindrical heater is fitted in a cylindrical nozzle, and the liquid in the nozzle is separated into two portions by the bubble formed in the nozzle. However, this system also has a problem that a large number of ultramicroscopic liquid droplets are generated at the same time as a primary liquid droplet is generated.

The specification of U.S. Pat. No. 4,638,337 also presents a structure of the bubble-air integration system, in its Prior Art section. However, this patent presents this structure, in which a bubble generated in liquid by the thermal energy given by a heat generating element becomes connected to the atmospheric air, as an undesirable example of the liquid ejection head structure in which ink fails to be ejected or ink is ejected in a direction deviating from the predetermined direction.

This phenomenon occurs under a specific abnormal condition. For example, if a bubble, which has been grown by the driving of a heat generating element, ejects liquid at a point in time when the meniscus, which is desired to be located adjacent to the ejection orifice of an ink path (nozzle) at the moment of ink ejection, has just retracted toward the heat generating element, the liquid, or the ink, is ejected in an undesirable manner.

This is evident because this phenomenon is clearly described, as an undesirable example, in the specification of U.S. Pat. No. 4,638,337.

On the other hand, examples of practical application of the bubble-air connection system are disclosed in Japanese Laid-Open Patent Applications Nos. 10940/1992, 10941/1992, 10942/1992 and 12859/1992. These inventions disclosed in Japanese official gazettes resulted from the pursuit of the causes of the generation of the aforementioned liquid splashes or ink splashes by bubble explosion, and the unreliable bubble formation. They are recording methods which comprise a process in which thermal energy is given to the liquid in a liquid path in an amount large enough to cause the liquid temperature to suddenly rise to a point at which so-called "film boiling" of the liquid occurs and a bubble is generated in the liquid in the liquid path, and a process in which the bubble generated in the recording process becomes connected to the atmospheric air.

According to these recording methods, which cause a bubble to become connected to the atmospheric air adjacently to the ejection orifice of the liquid path, liquid can be desirably ejected in response to a recording signal without causing the splashing of liquid or formation of liquid mist, which is liable to occur in the case of a conventional printer or the like, adjacently to ejection orifices.

SUMMARY OF THE INVENTION

From the viewpoint of the uniformity with which a bubble grows and becomes connected with the atmospheric air, in other words, from the viewpoint of reliability in liquid ejection accuracy, the aforementioned bubble-air connection liquid ejection method is desired to be used with a so-called side shooter type liquid ejection head, in which ejection orifices are positioned to directly face corresponding electrothermal transducers.

However, as a liquid droplet ejected from the aforementioned side shooter type liquid ejection head is reduced in volume to form an image of higher quality, the way a bubble becomes connected to the atmospheric air affects the direction in which a liquid droplet is ejected. In particular if the volume of a liquid droplet is reduced to no more than $20\times10^{-15}m^3$, the trailing portion (portion which connects the primary-droplet-to-be portion to the liquid path), and the satellite liquid droplets generated by the trailing portion, affect image quality. In addition, the smaller the liquid droplet volume, the higher the probability of ultramicroscopic airborne liquid mist being generated, and therefore, the image quality becomes worse due to the adhesion of the liquid mist to the recording surface of a sheet of recording medium.

Thus, the primary object of the present invention is to provide a liquid ejection method that uses a liquid ejection head capable of ejecting extremely small liquid droplets, and in which a bubble connects to the atmospheric air, in such a way that liquid droplets are ejected without deviating from the predetermined ejection direction, thereby accomplishing high quality recording.

Another object of the present invention is to provide a liquid ejection method which does not allow liquid mist to be generated even when liquid droplets are reduced extremely in volume in order to increase image quality.

The present invention was made as an innovative liquid ejection method based on the bubble-air connection system, and was discovered during the research and development carried out to solve the aforementioned problems in the liquid ejection methods based on the bubble-air connection system which had been disclosed earlier. The knowledge acquired by the inventors of the present invention during the research and development carried out in order to accomplish the aforementioned objects are as follows.

The present invention was made by paying attention to the fact that the formation of a bubble by heat is an extremely stable process, but if the volume of a liquid droplet is reduced enough to achieve a high quality image, even an extremely small amount of change to a bubble is not insignificant. Furthermore, a small amount of "wetting" which is caused by ink droplets adjacent to ejection orifices is not insignificant in terms of the direction in which liquid droplets are ejected. Prior to the aforementioned research and development conducted by the inventors of the present invention, attention had been paid only to the process in which a bubble becomes connected to the atmospheric air, whereas the present invention pays attention to a process subsequent to the bubble connecting to the atmospheric air, as well as to the connecting process.

The essence of the present invention, which is based on the above-described knowledge, is as follows.

The present invention is characterized in that in a liquid ejection method, which employs a liquid ejection head comprising electrothermal transducers for generating thermal energy for ejecting liquid, liquid ejection orifices positioned so as to face, one for one, the electrothermal transducers, and liquid paths which lead, one for one, to the liquid ejection orifices, delivering liquid to the ejection orifices, and in which each of the electrothermal transducers is disposed on the bottom surface and ejects the liquid with the use of the pressure of a bubble generated through a process in which the liquid in the liquid path is caused to undergo a change of state by the application of thermal energy to the liquid, the generated bubble is allowed to become connected to the atmospheric air only after the bubble begins to reduce in volume after it grows to its maximum volume.

Furthermore, the present invention is characterized in that a liquid ejection method, which employs a liquid ejection head comprising electrothermal transducers for generating thermal energy for ejecting liquid, liquid ejection orifices positioned so as to face, one for one, the electrothermal transducers, and liquid paths which lead, one for one, to the liquid ejection orifices, delivering liquid to the ejection orifices, and in which each of the electrothermal transducers is disposed on the bottom surface, and ejects the liquid with the use of the pressure of a bubble generated through a process in which the liquid in the liquid path is caused to undergo a change of state by the application of thermal energy to the liquid, comprises a process in which atmospheric air is introduced into the liquid path to which the bubble becomes connected, a process in which the liquid reaches the electrothermal transducers after the introduction of the atmospheric air into the liquid path, and a process in which a small amount of the liquid in the liquid path is separated from the liquid in the liquid path and forms a liquid droplet.

Furthermore, the present invention is characterized in that in a liquid ejection method, which employs a liquid ejection head comprising electrothermal transducers for generating thermal energy for ejecting liquid, liquid ejection orifices, positioned so as to face, one for one, the electrothermal transducers, and liquid paths which lead, one for one, to the liquid ejection orifices, delivering liquid to the ejection orifices, and in which each of the electrothermal transducers is disposed on the bottom surface, and ejects the liquid with the use of the pressure of a bubble generated through a process in which the liquid in the liquid path is caused to undergo a change of state by the application of thermal energy to the liquid, the liquid which is in the liquid path and which covers the electrothermal transducer in the liquid path is separated by a small portion, and becomes a liquid droplet, at the same time as the bubble becomes connected to the atmospheric air and the atmospheric air is introduced into the liquid path.

Further, the present invention is characterized in that in a liquid ejection method, which employs a liquid ejection head comprising electrothermal transducers for generating thermal energy for ejecting liquid, liquid ejection orifices positioned so as to face, one for one, the electrothermal transducers, and liquid paths which lead, one for one, to the liquid ejection orifices, delivering liquid to the ejection orifices, and in which the each of electrothermal transducers is disposed on the bottom surface, and ejects the liquid with the use of the pressure of a bubble generated through a process, in which the liquid in the liquid path is caused by undergo a change of state by the application of thermal energy to the liquid, the liquid is ejected as the bubble becomes connected to the atmospheric air after the growth speed of the bubble becomes negative.

According to any of the liquid ejection head structures described above, a bubble is allowed to become connected to the atmospheric air only after the bubble begins to decrease in volume. Therefore, in the process in which a primary liquid droplet is formed, the portion of the liquid which is immediately adjacent to the top portion of the bubble and extends downward (toward the electrothermal transducer) from the primary droplet portion of the liquid, and which, if ejected, will form satellite liquid droplets that are the source of the splashing which occurs during the liquid ejection, can be separated from the primary droplet portion. Therefore, the amount of mist is substantially reduced, which in turn considerably reduces the amount of the soiling which occurs to the recording surface of a sheet of recording medium due to the mist. Further, the portion of the liquid which will form satellite ink droplets if ejected is dropped onto, or caused to adhere to, the electrothermal transducer. After dropping onto, or adhering to, the electrothermal transducer, this portion of the liquid possesses a vector that is parallel to the surface of the electrothermal transducer, and therefore, this portion, that is, the potential satellite droplet portion, is easily separated from the primary droplet portion of the liquid. Therefore, as described above, the amount of the mist is substantially reduced, which in turn considerably reduces the amount of the soiling which occurs to the recording surface of a sheet of recording medium due to the mist. Furthermore, according to the above-described structure, the point at which the primary droplet portion of the liquid is separated from the rest of the liquid aligns with the central axis of the ejection hole, and therefore, the direction in which the liquid is ejected is stabilized. In other words, the liquid is always ejected in the direction substantially perpendicular to the surface of the electrothermal transducer, that is, the liquid ejecting surface of the head. As a result, it is possible to record a high-quality image which does not suffer from the problems traceable to the deviation due to the liquid ejection direction.

Whether a bubble becomes connected to the atmospheric air during its growth or during its contraction depends on the geometric factors of the liquid path and the ejection orifice, the size of the electrothermal transducer, and also the properties of the recording liquid.

More specifically, if the flow resistance of a liquid path (between electrothermal transducer and liquid supply path) is low, it is easier for a bubble to grow toward the liquid supply path, which reduces the bubble growth speed toward an ejection orifice. Thus, the connection between a bubble and the atmospheric air is more likely to occur during the contraction of the bubble. If a plate (hereinafter "orifice plate") through which ejection holes are formed is increased in thickness, the viscosity resistance of the recording liquid during bubble growth increases, and therefore, the connection between a bubble and the atmospheric air is more likely to occur during the contraction of the bubble. Furthermore, a thicker orifice plate stabilizes a liquid ejection head in terms of liquid ejection direction, and therefore, the smaller the deviation in liquid ejection direction. This also makes a thicker orifice plate more desirable. If an electrothermal transducer is excessively large, the connection between a bubble and the atmospheric air is more liable to occur during the growth of the bubble. Therefore, attention must be paid to the electrothermal transducer size. Furthermore, if the recording liquid viscosity is excessively high, the connection between a bubble and the atmospheric air is more likely to occur during the contraction of the bubble.

Furthermore, the way a bubble becomes connected to the atmospheric air changes depending on the cross-section of the ejection hole in an orifice plate, which cross-section is perpendicular to the axis of the hole. More specifically, assuming that an ejection orifice diameter remains the same, the greater the angle of the taper of the ejection hole wall in the cross section (the smaller the orifice diameter relative to the diameter of the bottom opening of the ejection hole), the more likely the connection between a bubble and the atmospheric air will occur during the contraction of the bubble.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 1A and 1B are drawings which depict the general structure of a liquid ejection head to which the ink ejection method in accordance with the present invention is applicable, FIG. 1A being an external perspective view of the head, and FIG. 1B being a section of the head at the line 1B—1B in FIG. 1A.

FIGS. 3A–3H are sectional drawings which depict the liquid ejection sequence in the liquid ejection method in accordance with the present invention, and in which FIGS. 3A–3H represent essential stages of the liquid ejection.

FIGS. 4A–4G are sectional drawings which depict the liquid ejection sequence in a conventional liquid ejection method, and in which FIGS. 4A–4G represent essential stages of the liquid ejection.

FIGS. 5A–5F are sectional drawings which depict the manufacturing sequence for a desirable liquid ejection head which is compatible with the liquid ejection method in accordance with the present invention, and in which FIGS. 5A–5H represent the essential manufacturing steps.

DESCRIPTION OF THE PREFERRED EMBODIMENTS

Embodiment 1

Figure 2A:
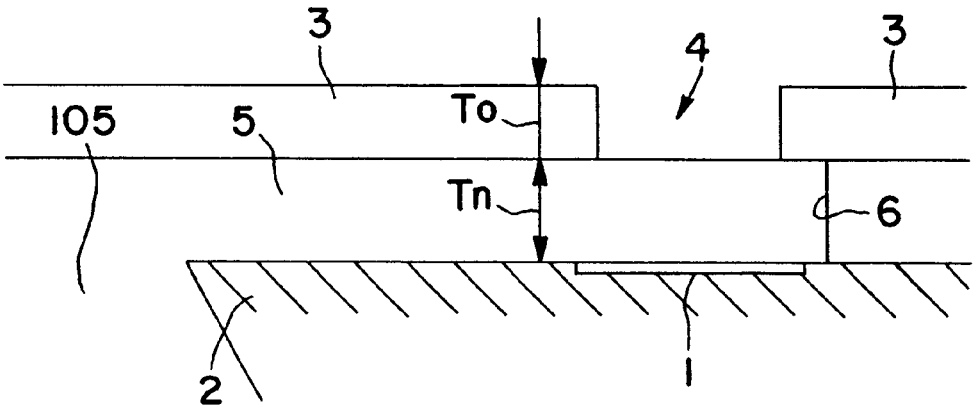
FIGS. 2A and 2B are drawings which depict the essential portion of the liquid ejection head illustrated in FIGS. 1A and 1B, FIG. 2A being a vertical section of the liquid path, which section is parallel to the direction in which the liquid path runs, and FIG. 2B being a plan of the liquid path as seen from the ejection orifice side.

FIGS. 1A and 1B are drawings which depict the general structure of a liquid ejection head to which the ink ejection method in accordance with the present invention is applicable, in which FIG. 1A is an external perspective view of the head, and FIG. 1B is a section of the head at the line 1B—1B in FIG. 1A.

In FIGS. 1A and 1B, reference character 2 designates a piece of Si substrate, on which heaters 1 and ejection orifices 4 have been formed with the use of thin-film technology. The heater 1 is constituted by an electrothermal transducer, which will be described later. The orifice 4 is located so that it directly faces the heater 1. Referring to FIG. 1A the element substrate 2 is provided with a plurality of ejection orifices 4, which are arranged in two straight lines, with the orifices 4 in one line being offset, in terms of the line direction, from the corresponding orifices 4 in the other line. The element substrate 2 is fixed, by gluing, to a portion of a support member 102 shaped in the form of the letter L, also to this support member 102, a wiring substrate 104 is fixed at the top. The wiring portions of the wiring substrate 104 and the element substrate 2 are electrically connected by wire bonding. The support member 102 is formed of aluminum or a similar material in consideration of cost, ease of manufacturing, and the like. Reference character 103 designates a molded member provided with an internal liquid supply path 107, and a liquid storage chamber (unillustrated). The liquid (ink, for example) stored in the liquid storage chamber is delivered to the aforementioned ejection orifices of the element substrate 2 through the liquid supply path 107.

Furthermore, the molded member 103 supports the support member 102, as a portion of the support member 102 is inserted into a portion of the molded member 103. Further, the molded member 103 functions as a member which plays a role in removably and accurately fixing the entirety of the liquid ejection head in this embodiment, in the correct position, to the liquid ejection apparatus, which will be described later.

The element substrate 2 is provided with paths 105, which run through the element substrate 2 in a direction parallel to the element substrate 2, and through which the liquid delivered through the liquid supply path 107 in the molded member 103 is further delivered to the ejection orifices 4. These paths 105 are connected to each of the liquid paths, which lead to their own ejection orifices. They function not only as liquid paths, but also as a common liquid chamber.

Figure 2B:
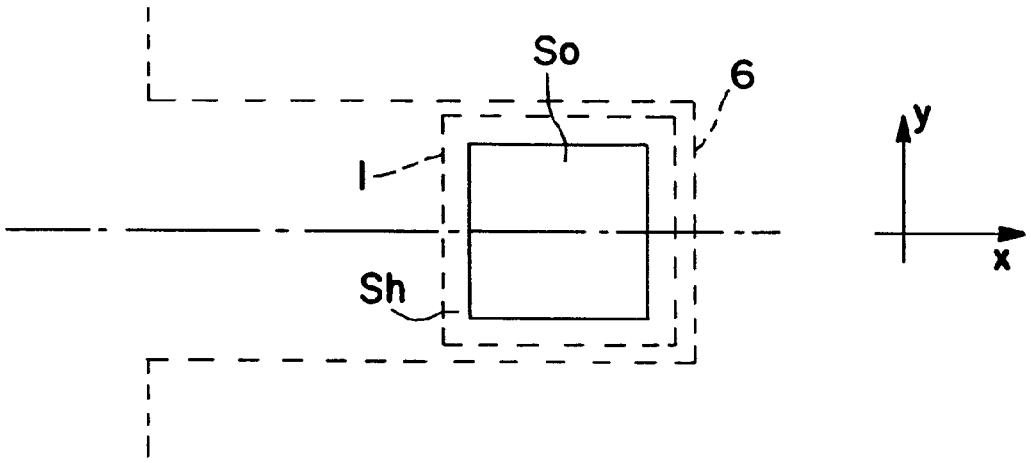

FIGS. 2A and 2B are drawings which depict the essential portion of the liquid ejection head illustrated in FIGS. 1A and 1B. FIG. 2A is a vertical section of the liquid path, which section is taken parallel to the direction in which the liquid path runs, and FIG. 2B is a plan of the liquid path as seen from the ejection orifice side.

Referring to FIGS. 2A and 2B, the element substrate 2 is provided with a plurality of rectangular heaters 1, or electrothermal transducers, which are located at predetermined locations. There is an orifice plate 3 above the heaters 1. The orifice plate 3 is provided with a plurality of rectangular openings, or ejection orifices 4, which directly face the aforementioned heaters 1, one for one. Although the shape of the ejection orifice 4 in this embodiment is rectangular, the shape of the ejection orifice 4 does not need to be limited to the rectangular shape. For example, it may be circular. Furthermore, in this embodiment, the size of the outside orifice, or the ejection orifice 4, of the ejection hole is represented as being the same as that of the inside orifice of the ejection hole; however, the outside orifice, or the ejection orifice 4, of the ejection hole may be made smaller than the inside orifice. In other words, the ejection hole may be tapered, since the tapering of the ejection hole improves stability in liquid ejection.

Referring to FIG. 2A, the gap between the heater 1 and the orifice plate 3 equals the height Tn of the liquid path 5, being regulated by the height of the side wall 6 of the liquid path. If the liquid path 5 is extended in the direction indicated by arrow x in FIG. 2B, the plurality of ejection orifices 4, which are in connection with the corresponding liquid paths 5, are aligned in the direction indicated by arrow y which is perpendicular to the direction x. The plurality of liquid paths 5 are in connection with the path 105, illustrated in FIG. 1B, which also functions as the common liquid chamber. The distance from the top surface of the heater 1 to the ejection orifice 4 is $T_0$+Tn, where "$T_0$" and "Tn" stand for the thickness of the orifice plate 3, which equals the distance from the ejection orifice 4 to the liquid path 5, and the thickness of the liquid path wall 6, respectively. In this embodiment, the values of $T_0$ and Tn are 12 $\mu$m and 13 $\mu$m, respectively.

The driving voltage is in the form of a single pulse which has a duration of 2.9 $\mu$sec, for example, and a value of 9.84 V, that is, 1.2 times the ejection threshold voltage. The properties of the ink, or the liquid, used in this embodiment, may be as follows:

Viscosity: $2.2\times10^{-2}$N/sec

Surface tension: $38\times10^{-3}$N/m

Density: 1.04 g/cm$^3$

Next, an example of the liquid ejection method in accordance with the present invention, which is carried out using the liquid ejection head with the above described structure, will be described.

Figure 3A:
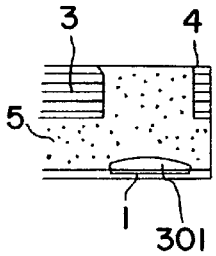
Figure 3B:
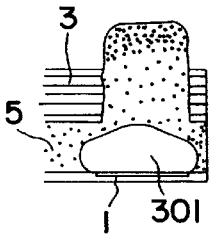
Figure 3C:
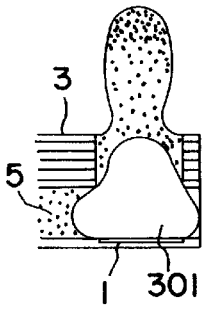
Figure 3D:
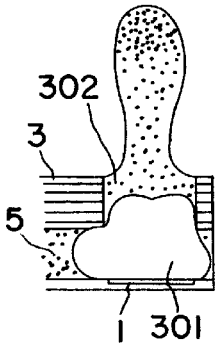
Figure 3E:
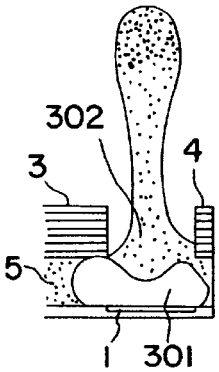
Figure 3F:
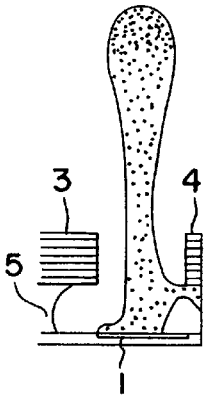
Figure 3G:
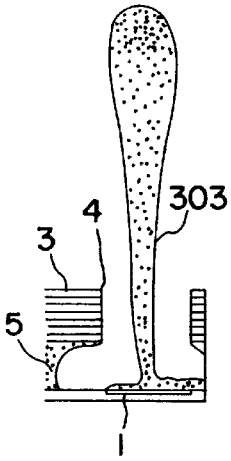
Figure 3H:
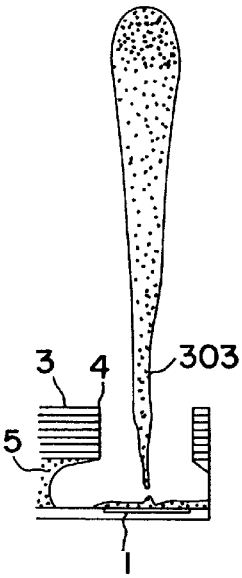

FIGS. 3A–3H are sectional drawings which depict the operational sequence of the liquid ejection head which is used to carry out the liquid ejection method in accordance with the present invention. The direction of the sectional plane in this drawing is the same as that of the drawing in FIG. 2A. FIG. 3A depicts the initial stage of bubble growth on the heater 1, at which a bubble has begun to grow on the heater 1; FIG. 3B, a stage approximately 1 $\mu$sec after the stage in FIG. 3A; FIG. 3C, a stage approximately 2.5 $\mu$sec after the stage in FIG. 3A; FIG. 3D, a stage approximately 3 $\mu$sec after the stage in FIG. 3A; FIG. 3E, a stage approximately 4 $\mu$sec after the stage in FIG. 3A; FIG. 3F, a stage approximately 4.5 $\mu$sec after the stage in FIG. 3A; FIG. 3G, a stage approximately 6 $\mu$sec after the stage in FIG. 3A; and FIG. 3H depicts a stage approximately 9 $\mu$sec after the stage in FIG. 3A. In FIGS. 3A–3H, the horizontally hatched portions represent the orifice plate or the liquid path wall, and the portions covered with small dots represent liquid. The dot density represents the liquid velocity. In other words, if a portion is covered with dots at a high density, the portion has high velocity, and if a portion is covered with dots at a low density, the portion has low velocity.

Referring to FIG. 3A, as electric power to the heater 1 is turned on in response to recording signals or the like, a bubble 301 begins to be generated on the heater 1 in the liquid path 5. Then, the bubble 301 rapidly grows in volume for approximately 2.5 $\mu$sec as depicted in FIGS. 3B and 3C. By the time the bubble 301 reaches its maximum volume, the highest point of the bubble 301 reaches beyond the top surface of the orifice plate, and the bubble pressure becomes lower than the atmospheric pressure, reducing to approximately 1/14–1/15 to 1/4–1/5 of the atmospheric pressure. Then, approximately 2.5 $\mu$sec after the generation of the bubble 301, the bubble 301 begins to lose its volume from the above described maximum size, and at approximately the same time, a meniscus 302 begins to form. Referring to FIG. 3D, the meniscus 302 retreats toward the heater 1. In other words, it falls down through the ejection hole.

The above expression "falls down" does not mean that the meniscus falls in the gravitational direction. It simply means that the meniscus moves toward the electrothermal transducer, having little relation to the direction in which the head is attached. This also applies to the following description of the present invention.

Since the speed at which the meniscus 302 falls is greater than the speed at which the bubble 301 contracts, the bubble 301 becomes connected or communicates with the atmospheric air, near the bottom orifice of the ejection hole, approximately 4 $\mu$sec after the start of the bubble growth, as depicted in FIG. 3E. From this moment, the liquid (ink) adjacent to the central axis of the ejection hole begins to fall toward the heater 1. This is due to the inertia of the liquid; the liquid portion which is pulled back toward the heater 1 by the negative pressure of the bubble 301 continues to move toward the heater 1 even after the bubble 301 becomes connected with the atmospheric air. The liquid (ink) portion continues to fall toward the heater 1, and reaches the top surface of the heater 1 approximately 4.5 $\mu$sec after the start of the bubble growth, as depicted in FIG. 3F, and begins to spread, covering the top surface of the heater 1 as depicted in FIG. 3G. The liquid portion which is spreading in such a manner as to cover the top surface of the heater 1 possesses a certain amount of velocity parallel to the top surface of the heater 1, but has lost the velocity which intersects with the top surface of the heater 1, for example, the velocity perpendicular to the top surface of the heater 1. Thus, the bottom portion of the liquid adheres to the heater surface, pulling downward the portion above, which still possesses a certain amount of velocity directed toward the ejection orifice 4. Then, the column portion 303 of the liquid between the bottom portion of the liquid, which is spreading in a manner to cover the heater 1, and the top portion (primary droplet) of the liquid, gradually narrows, and eventually separates into the top and bottom portions, above the approximate center of the heater 1, approximately 9 $\mu$sec after the start of the bubble growth. The top portion of the column portion 303 of the liquid is integrated into the top portion (primary droplet) of the liquid, which still possesses velocity in the direction of the ejection orifice 4, and the bottom portion of the column portion 303 of the liquid is integrated into the bottom portion of the liquid, which has spread in a manner to cover the heater surface. It is desirable that the point of the column portion 303 of the liquid, at which the column portion 303 separates, be closer to the electrothermal transducer than to the ejection orifice 4. The primary liquid droplet is ejected from the ejection orifice 4, in virtually symmetrical form, with no deviation from the predetermined ejection direction, and lands on the recording surface of a piece of recording medium at a predetermined location. In the case of a liquid ejection head and a liquid ejection method prior to the present invention, the liquid portion which adheres to the top surface of the heater 1 flies out as satellite droplets, following the primary droplet, but in the case of the liquid ejection head and liquid ejection method in this embodiment, the portion of the liquid which adheres to the top surface of the heater 1 is prevented from flying out as satellite droplets, remaining adhered to the heater surface. In other words, the liquid ejection head and liquid ejection method in this embodiment can reliably prevent the liquid from being ejected as satellite droplets, which are liable to result in the so-called "splash" effect. The head and method can reliably prevent the recording surface of the recording medium from being soiled by airborne liquid mist.

When the liquid ejection head in this embodiment was driven at a frequency of 10 kHz to print an image, the ejection error in terms of direction was only 0.4 deg. at the maximum, and it was impossible to detect the "mist" even around a black letter so that desirable images could be recorded.

COMPARATIVE EXAMPLE

For the purpose of comparison, a liquid ejection head which had a structure similar to the one depicted in FIGS. 2A and 2B was produced, except for the dimensions of certain portions. In the comparative liquid ejection head, the thickness $T_0$ of the orifice plate 3, which equals the distance from the ejection orifice 4 to the liquid path 5 was 9 $\mu$m ($T_0$=9 $\mu$m), and the height Tn of the liquid path 5 was 12 $\mu$m (Tn=12 $\mu$m). The pulse used to drive this comparative head was in the form of a single pulse which had a width of 2.9 $\mu$sec, and a driving value of 9.72 V, or 1.2 times the ejection threshold voltage value of 2. The ink used to test the comparative head had the same properties as the ink used as the liquid described in the preceding embodiment.

Next, a conventional liquid ejection method will be described with reference to a liquid ejection head structured as described above.

Figure 4A:
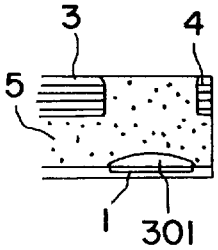
Figure 4B:
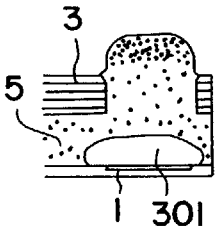
Figure 4C:
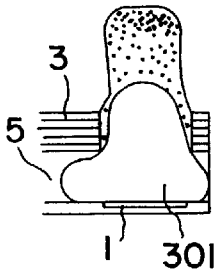
Figure 4D:
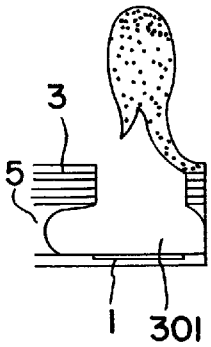
Figure 4E:
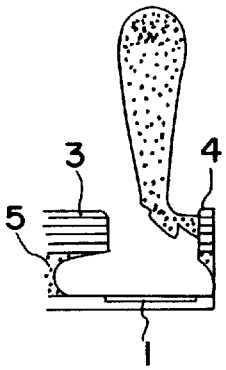
Figure 4F:
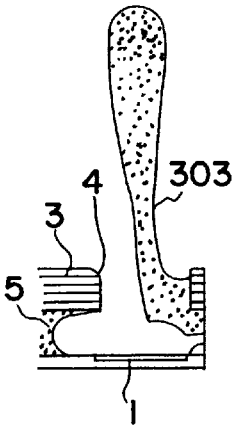
Figure 4G:
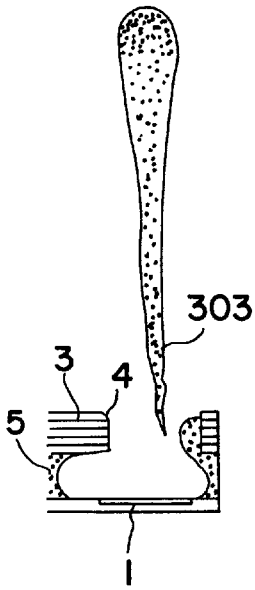

FIGS. 4A–4G are sectional drawings which depict the liquid ejection sequence in a conventional liquid ejection method, and represent essential stages of the liquid ejection. The direction of the sectional plane in this drawing is the same as the one in FIG. 2A. FIG. 4A depicts the initial stage in bubble growth on the heater 1, at which a bubble has begun to grow on the heater 1; FIG. 4B, a stage approximately 0.5 $\mu$sec after the stage in FIG. 4A; FIG. 4C, a stage approximately 1.5 $\mu$sec after the stage in FIG. 4A; FIG. 4D, a stage approximately 2 $\mu$sec after the stage in FIG. 4A; FIG. 4E, a stage approximately 3 $\mu$sec after the stage in FIG. 4A; FIG. 4F, a stage approximately 5 $\mu$sec after the stage in FIG. 4A; and FIG. 4G depicts a stage approximately 7 $\mu$sec after the stage in FIG. 4A. In FIGS. 4A–4G, the horizontally hatched portions represent the orifice plate or the liquid path wall, and the portions covered with small dots represent liquid, as they did in FIGS. 3A–3H. The dot density represents the liquid velocity, also as it did in FIGS. 3A–3H. In other words, if a portion is covered with dots with high density, the portion has high velocity, and if a portion is covered with dots with low density, the portion has low velocity.

Immediately after generation, the bubble 301 rapidly grows in volume as depicted in FIGS. 4A and 4B. Then, the bubble 301 becomes connected to the atmospheric air as depicted in FIG. 4C while expanding, or growing. The point of connection between the bubble 301 and the atmospheric air is slightly above the ejection orifice 4, that is, slightly above the top surface of the orifice plate. Immediately after the connection, the column portion 303 of the liquid, which extends from the liquid portion which will become the primary liquid droplet, is still partially clinging to the wall of the ejection hole, as shown in FIGS. 4D–4G. Then, the primary droplet portion of the liquid becomes separated from the column portion 303 of the liquid, at a point slightly above the ejection orifice 4. At this point in time, the column portion 303 of the liquid is still partially in contact with the wall of the ejection hole. In other words, the wall of the ejection hole is wet with the liquid. Therefore, the point where the primary droplet portion of the liquid becomes separated from the column portion 303 of the liquid is slightly off the central axis of the ejection hole. This is likely to cause the trajectory of the primary droplet portion of the liquid to deviate from the normal direction, and also to generate liquid mist. In the case of this comparative example, the deviation in terms of the ejection direction was 1.5 deg. at the maximum, and liquid mist could be detected with the naked eye, although small in amount.

The liquid path of the liquid ejection head structured as shown in FIGS. 2A and 2B is not symmetrical relative to the imaginary line drawn through the center of the heater 1 parallel to the axis y, and therefore, it is also not symmetrical in terms of liquid flow dynamics. Consequently, the point at which the bubble 301 becomes connected to the atmospheric air is slightly off the central axis of the ejection hole, or the center of the ejection orifice 4.

Further, even if the orifice plate 3 is uniformly given a liquid repellency treatment across the top surface (hereinafter, "ejection orifice surface"), where the ejection orifices 4 are present, it sometimes occurs that as the head is repeatedly driven for image formation or the like, the ejection orifice surface is wetted in an irregular pattern, adjacently to the ejection orifices 4. This wetness in an irregular pattern is liable to cause deviation in liquid ejection direction.

Therefore, the comparative liquid ejection head cannot completely eliminate the effects of the above-described head structure and liquid repellency treatment, and therefore, it cannot completely prevent the deviation in ejection direction.

On the contrary, in the case of the present invention, even when a head is used which is liable to suffer from the effects of directional deviation in liquid ejection caused by the asymmetry in liquid flow traceable to the liquid ejection head structure and/or the accidental asymmetry such as the asymmetry in the pattern of the "wetting" on the top surface of the orifice plate, adjacent to the ejection orifices 4, such effects are prevented from arising. In other words, the direction in which the liquid droplet is ejected is stabilized; the deviation in liquid ejection direction can be completely prevented.

As one of the conditions which improve the liquid ejection method in accordance with the present invention, it is possible to indicate the increasing of the values of Tn and/or $T_0$ as described above. Further, it is important as a driving condition that the ratio of the driver voltage relative to the ejection threshold voltage is not allowed to exceed 1.35. If this ratio is allowed to exceed 1.35 (if the driver voltage is excessively increased), the merging point between the bubble and atmospheric air shifts upward, which is liable to cause the problem of deviation in liquid ejection direction.

OTHER EMBODIMENTS

In this embodiment, printing was carried out using a liquid ejection head which was substantially the same in structure as the liquid ejection head in the preceding embodiment, except that it was different in the height Tn (=10 $\mu$m) of the liquid path and the thickness $T_0$ (=15 $\mu$m) of the orifice plate. The ink was the same as the ink in the preceding embodiment. The driving conditions are also substantially the same as those in the preceding embodiment: single pulse with a width of 2.8 $\mu$sec, and a voltage value of 9.96 V, or 1.2 times the ejection threshold voltage value.

In this embodiment, a liquid droplet volume of approximately $9\times10^{-15}$ $m^3$, and an ejection velocity of 15 m/sec, were achieved. The liquid ejection head was driven at an ejection frequency of 10 kHz, producing desirable prints, that is, prints which were only slightly affected by liquid ejection deviation and mist.

Figure 7A:
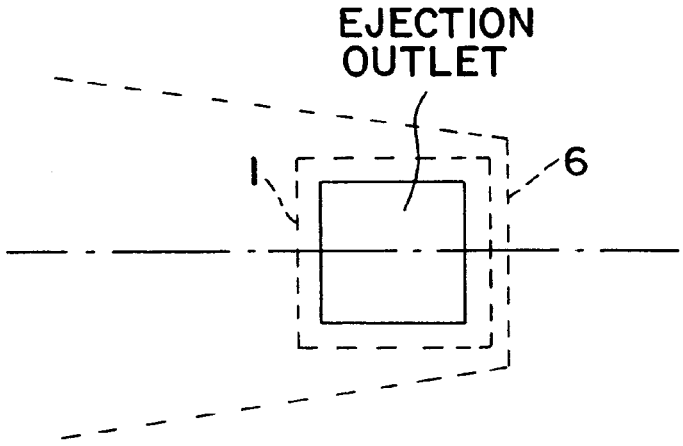
FIGS. 7A and 7B are plans of the essential portion of another desirable liquid ejection head compatible with the liquid ejection method in accordance with the present invention, both FIGS. 7A and 7B being top plans.
Figure 7B:
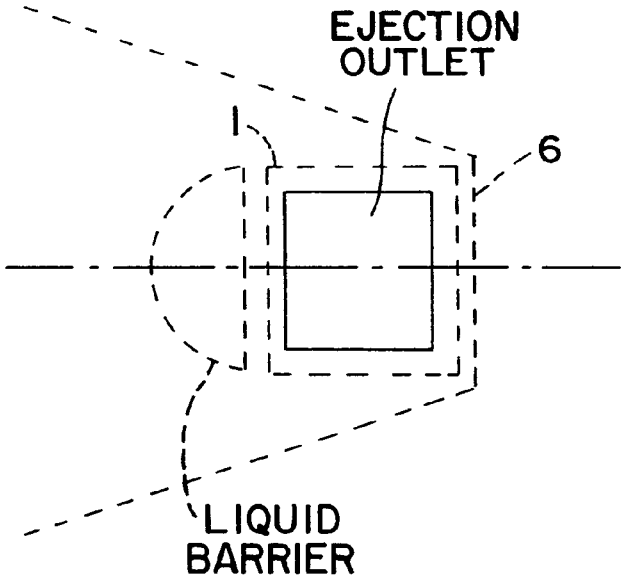

The present invention is applicable not only to a liquid ejection head which has a liquid path the width of which is uniform as shown in FIG. 2B, but also to a liquid ejection head which has a liquid path the width of which becomes narrower toward the electrothermal transducer, as shown in FIG. 7A, and a liquid ejection head provided with a liquid barrier which is located in the liquid path adjacently to the electrothermal transducer, as shown in FIG. 7B. Further, the present invention is applicable not only to a liquid ejection head the ejection orifice of which is square, but also to a liquid ejection head the ejection orifice of which is circular or elliptical.

Next, referring to FIGS. 5A–5F, one of the methods for manufacturing the liquid ejection head illustrated in FIGS. 2A and 2B will be described.

FIGS. 5A–5F are sectional drawings which depict the manufacturing sequence for the aforementioned liquid ejection head, and represent the essential manufacturing steps.

Figure 5A:
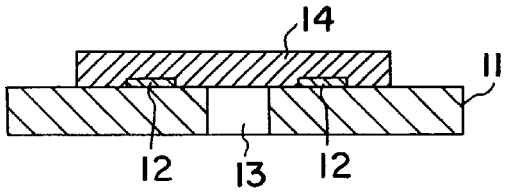

First, a piece of substrate 11, illustrated in FIG. 5A, which is composed of glass, ceramic, plastic, or metal, is prepared.

The choice of the material or shape for the substrate 11 does not need to be limited. Any material or shape can be employed as long as it allows the substrate 11 to function as a part of the liquid paths, and also as a member for supporting a layer of material in which ink paths and ink ejection orifices are formed. On the substrate 11, a predetermined number of ink ejection energy generation elements 12 such as an electrothermal transducer or a piezoelectric element are arranged. Recording is made as ejection energy for ejecting a microscopic droplet of recording liquid is applied to the ink by these ink ejection energy generation elements 12. For example, when an electrothermal transducer is employed as the ink ejection energy generation element 12, the ejection energy is generated as this element changes the state of the recording liquid adjacent to the element by heating the recording liquid. On the other hand, when the piezoelectric element is employed, the ejection energy is generated by the mechanical vibrations of this element.

To these elements 12, control signal input electrodes (unillustrated) for operating these elements 12 are connected. Generally, for the purpose of improving the durability of these ejection energy generation elements 12, the liquid ejection head is provided with various functional layers, such as a protective layer. Obviously, there will be no problem in that the liquid ejection head in accordance with the present invention is provided with these functional layers.

FIG. 5A depicts a head structure in which the substrate 11 is provided in advance with an ink supply hole 13 (passage), through which ink is supplied from the rear side of the substrate 11. As for the means for forming the ink supply passage 13, any means may be used as long as it can form a hole through the substrate 11. For example, the ink supply hole may be formed with the use of mechanical means such as a drill, or may be formed with the use of optical means such as a laser beam. Furthermore, it may be formed with the use of chemical means, for example, by etching a hole with the use of a resist pattern.

Obviously, the ink supply passage 13 does not need to be formed in the substrate 11. For example, it may be formed in the resin pattern, being positioned on the same side as the ink ejection hole 21 relative to the substrate 11.

Next, an ink path pattern 14 is formed on the substrate 11, with the use of dissolvable resin, covering the ink ejection energy generation elements 12 as shown in FIG. 5A. As for one of the most commonly used means for forming the ink path pattern 14, a means which uses photosensitive material can be mentioned, but the ink path pattern 14 can alternatively be formed by such a means as screen printing or the like. When photosensitive material is used, the ink path pattern is dissolvable, and therefore, it is possible to use positive type resist or a negative type resist, the dissolvability of which can be changed.

As for a method for forming the resist layer, when the ink passage 13 is provided on the substrate 11 side, it is desirable that the ink path pattern 14 be formed by laminating a sheet of dry film of photosensitive material. As for a method for forming the dry film, photosensitive material is dissolved in an appropriate solvent, and the solution thus formed is applied as a coating to a sheet of film formed of polyethyleneterephthalate or the like, and dried. As for the material for the dry film, a photodisintegratable hypolymer compound such as polymethylisopropylketone or polyvinylketone, which belong to the vinylketone group, can be used with desirable results. This is because these chemical compounds maintain hypolymer characteristics. That is, they are easily formed into thin films, which can be easily laminated even across the ink supply passage 13 prior to their exposure to light.

Furthermore, the resist layer for the ink path 14 may be formed by an ordinary method such as spin coating or roller coating after filling the ink supply passage 13 with a filler that can be removed at a later manufacturing stage.

Figure 5B:
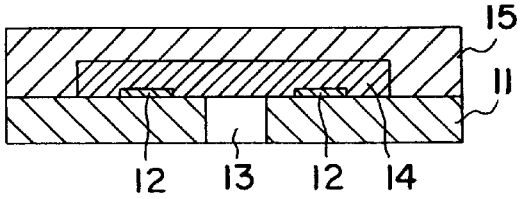

Next, a resin layer 15 is formed on the substrate 11 in such a manner as to cover the dissolvable resin layer formed in the pattern of the ink path 14, by an ordinary coating method such as spin coating or roller coating, as shown in FIG. 5B. One of the properties of the material for the resin layer 15 must be that it does not change the ink path pattern formed of the dissolvable resin. In other words, such solvent that does not dissolve the resin material for the ink path pattern must be chosen as the solvent for the material for the resin layer 15, so that the dissolvable ink path pattern is not dissolved while forming the resin material layer 15.

At this time, the resin layer 15 will be described. It is desirable that the resin layer 15 be formed of photosensitive material, so that the ink ejection hole, which will be described later, can be easily and precisely formed with the use of photolithography. The photosensitive material for the resin layer 15 is required to possess a high degree of mechanical strength required of structural material, the ability to be hermetically adhered to the substrate 11, and ink resistance, as well as photosensitivity high enough to allow a high resolution image of a microscopic pattern for forming the ink ejection hole to be precisely etched on the resin layer 15. As for such a material, cationically hardened epoxy resin is desirable, since it has superior mechanical strength required of structural material, the ability to be hermetically adhered to the substrate 11, ink resistance, and it also displays excellent patterning characteristics at ordinary temperatures at which it exists in the solid state.

Cationically hardened epoxy resin is higher in crosslinking density compared to epoxy resin hardened with the use of ordinary acid anhydride or amine, therefore displaying superior characteristics as a structural material. The use of such an epoxy resin that exists in the solid state at ordinary temperatures prevents polymerization initiator seeds, which come out of the polymerization initiator due to exposure to light, from being dispersed in the epoxy resin. Therefore, a high degree of patterning accuracy can be accomplished and the patterns can be formed with great precision.

The resin layer 15, which is formed over another resin layer which is dissolvable, is formed through a process in which the material for the resin layer 15 is dissolved into a solvent, and the prepared solution is spin coated over the target area.

The resin layer 15 can be uniformly and precisely formed by using spin coating technology, that is, one of thin film formation technologies. Thus, the distance (O–II distance) between an ink ejection pressure generation element 12 and the corresponding orifice can be easily reduced, which in turn makes it easier to manufacture a liquid ejection head capable of ejecting desirable small liquid droplets, which was difficult for a conventional manufacturing method.

Generally speaking, when the so-called negative type photosensitive material is used as the material for the resin layer 15, exposing light is reflected by the substrate surface, and/or scum (development residue) is generated. In the case of the present invention, however, the ejection orifice pattern (ejection hole pattern) is formed over the ink path pattern formed of the dissolvable resin. Therefore, the effects of the reflection of the exposure light by the substrate can be ignored. Furthermore, the scum which is generated during the development is lifted off during the process in which the dissolvable resin in the form of the ink path is washed out. Therefore, the scum does not create any ill effect.

As for the epoxy resin in the solid state to be used in the present invention, the following may be listed: an epoxy resin which is produced by causing bisphenol A to react with epichlorohydrin, and the molecular weight of which is 900 or more; an epoxy resin which is produced by causing bromophenol A to react with epichlorohydrin; an epoxy resin which is produced by causing phenol-novolac or o-creosol-novolac to react with epichlorohydrin; the multifunctional epoxy resin disclosed in Japanese Laid-Open Patent Applications Nos. 161973/1985, 221121/1988, 9216/1989 and 140219/1990, which has oxycyclohexene as its skeleton; and similar epoxy resins. Needless to say, the epoxy resins compatible with the present invention are not limited to the above listed resins.

As for the photocationic polymerization initiator for hardening the above epoxy resins, aromatic iodate; aromatic sulfonate (J. POLYMER SCI., Symposium No. 56, pp. 383-395/1976); SP-150 and SP-170, which are marketed by Asahi Electro-Chemical Industry Co., Ltd.; and the like can be named.

The above-named photocationic polymerization initiator further promotes cationic polymerization when it is used together with a reducing agent, and heat is applied (this procedure improves crosslinking density as compared with that in which a photocationic polymerization initiator is used alone, without heat application). However, when the photocationic polymerization initiator is used together with a reducing agent, the selection of the reducing agent must be made so that reaction does not occur at the working temperature, and occurs only when the temperature reaches a certain value (desirably, 60°C. or higher). In other words, a so-called redox system is created. As for the reducing agent, a copper compound, in particular, trifluoromethane cupric sulfonate (II), is most suitable. A reducing agent such as ascorbic acid is also useful. Furthermore, if it is necessary to increase the crosslinking density so that the number of nozzles can be increased (for high-speed printing), or non-neutral ink (to improve the water resistance of a coloring agent) can be used, the crosslinking density can be increased by using the above-named reducing agent in the following manner. That is, the reducing agent is dissolved in solvent, and the resin layer 15 is dipped in the solution of the reducing agent with the application of heat after the development process for the resin layer 15.

Furthermore, an additive may be added to the above listed material for the resin layer 15, as necessary. For example, an agent that increases flexibility may be added to the epoxy resin to reduce the elastic modulus of the epoxy resin, or a silane coupler may be added to the epoxy resin to further improve the state of the hermetical adhesion between the resin layer 15 and the substrate.

Figure 5C:
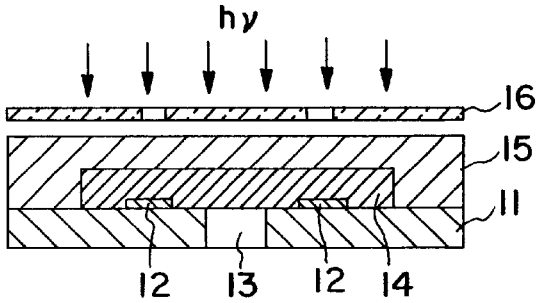

Next, the resin layer 15 formed of the above-described compound is exposed through a mask 16 as shown in FIG. 5C. Since the resin layer 15 is formed of a negative type photosensitive material, it is shielded by the mask, across the portions which correspond to the ink ejection holes (obviously, the portions to which electrical connection are to be made are also shielded, although not illustrated).

The light to be used for exposure may be selected from among ultraviolet radiation, deep-ultraviolet radiation, an electron beam, X-rays, and the like, in accordance with the photosensitive range of the employed cationic polymerization initiator.

The positional alignments in all of the above described liquid ejection head manufacture processes can be satisfactorily performed with the use of conventional photolithographic technologies, and therefore, accuracy can be remarkably improved compared to a method in which an orifice plate and a substrate are separately manufactured, and are then pasted together. The pattern-exposed photosensitive resin layer 15 may be heated to accelerate reaction. As described above, the photosensitive resin layer 15 is formed of an epoxy resin that remains in the solid state at working temperatures. Therefore, the dispersion of the cationic polymerization initiator, which is triggered by the pattern exposure, is regulated. As a result, excellent patterning accuracy is accomplished and the resin layer 15 is accurately shaped.

Figure 5D:
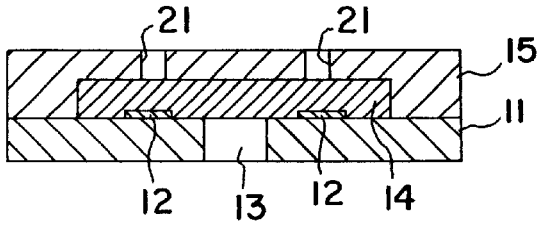
Figure 5E:
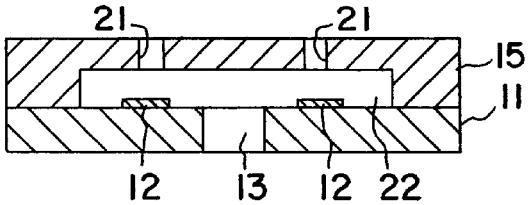

Next, the photosensitive resin layer 15 which has been pattern-exposed is developed with the use of an appropriate solvent, and as a result, ink ejection holes 21 are formed as shown in FIG. 5D. It is possible to develop the dissolvable resin pattern 14 for the ink path 22 at the same time as the unexposed portion of the resin layer 15 is developed. However, generally, a plurality of ink ejection heads, identical or different, are formed on a single large piece of substrate, and they are then separated through a dicing process to be used as individual liquid ejection heads. Therefore, only the photosensitive resin layer 15 may be selectively developed as shown in FIG. 5D, leaving the resin pattern 14 for forming the liquid path 22 undeveloped, as a measure for dealing with dicing dust (with the resin pattern 14 occupying the space for the liquid path 22, the dicing dust cannot enter the space), and the resin pattern 14 may be developed after the dicing (FIG. 5E). The scum (development residue) which is generated as the photosensitive resin layer 15 is developed is dissolved away together with the dissolvable resin layer 14, and for this reason does not remain in the nozzles.

As described above, if it is necessary to increase the crosslinking density, the photosensitive resin layer 15 is hardened by dipping it into a solvent which contains a reducing agent, and/or heating it after the ink path 22 is formed and the ink ejection hole 21 in the photosensitive resin layer 15 is completed. With this treatment, the crosslinking density in the photosensitive resin layer 15 is further increased, and the hermetical adhesion between the photosensitive resin layer 15 and the substrate, and the ink resistance of the head, are also considerably improved. Needless to say, this process, in which the photosensitive layer 15 is dipped into a solution that contains copper ions, and heat is applied, may be carried out with no problem, immediately after the photosensitive resin layer 15 is pattern-exposed, and the ink ejection hole 21 is formed by developing the exposed photosensitive resin layer 15. Then, dissolvable resin pattern 14 may be dissolved out after the dipping and heating process. Furthermore, the heating may be performed while dipping or after dipping.

With regard to the selection of a reducing agent, any substance will do as long as it has reducing capability. However, a cupric compound such as trifluoromethane cupric sulfonate (II), cupric acetate, cupric benzoate, or the like is more effective. In particular, trifluoromethane cupric sulfonate (II) is notably effective. The aforementioned ascorbic acid is also effective.

Figure 5F:
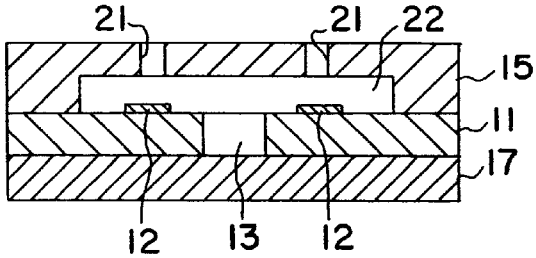

After the formation of the ink paths and ink ejection holes in the substrate, an ink supplying member 17, and electrical contacts (unillustrated), through which the ink ejection pressure generation elements 12 are driven, are attached to the substrate to complete an ink jet type liquid ejection head (FIG. 5F).

In the case of the manufacturing method in this embodiment, the ink ejection holes 21 are formed by photolithography. However, the method for forming the ink ejection holes 21 in accordance with the present invention does not need to be limited to photolithography. For example, they may be formed by a dry etching method (oxygen plasma etching) or with an excimer laser, with the use of different masks. When the ink ejection hole 21 is formed with the use of an excimer laser or a dry etching method, the substrate is protected by the resin pattern, thus being prevented from being damaged by the laser or plasma. In other words, the use of an excimer laser or a dry etching method makes it possible to produce a highly accurate and reliable liquid ejection head. Also, when the ink ejection hole 21 is formed by a dry etching method or an excimer laser, material other than the photosensitive material can be used as the material for the resin layer 15. For example, thermosetting material may be used.

In addition to the above-described liquid ejection head, the present invention is applicable to a full-line type liquid ejection head, which is capable of recording all at once across the entire width of a sheet of recording medium. The present invention is also applicable to a color liquid ejection head, which may comprise a single head or a plurality of monochromatic heads.

A liquid ejection head to be used with the liquid ejection method in accordance with the present invention may be a liquid ejection head that uses solid ink which liquefies only when it is heated to a certain temperature or higher.

Next, an example of a liquid ejection apparatus compatible with the above-described liquid ejection head will be described.

Figure 6:
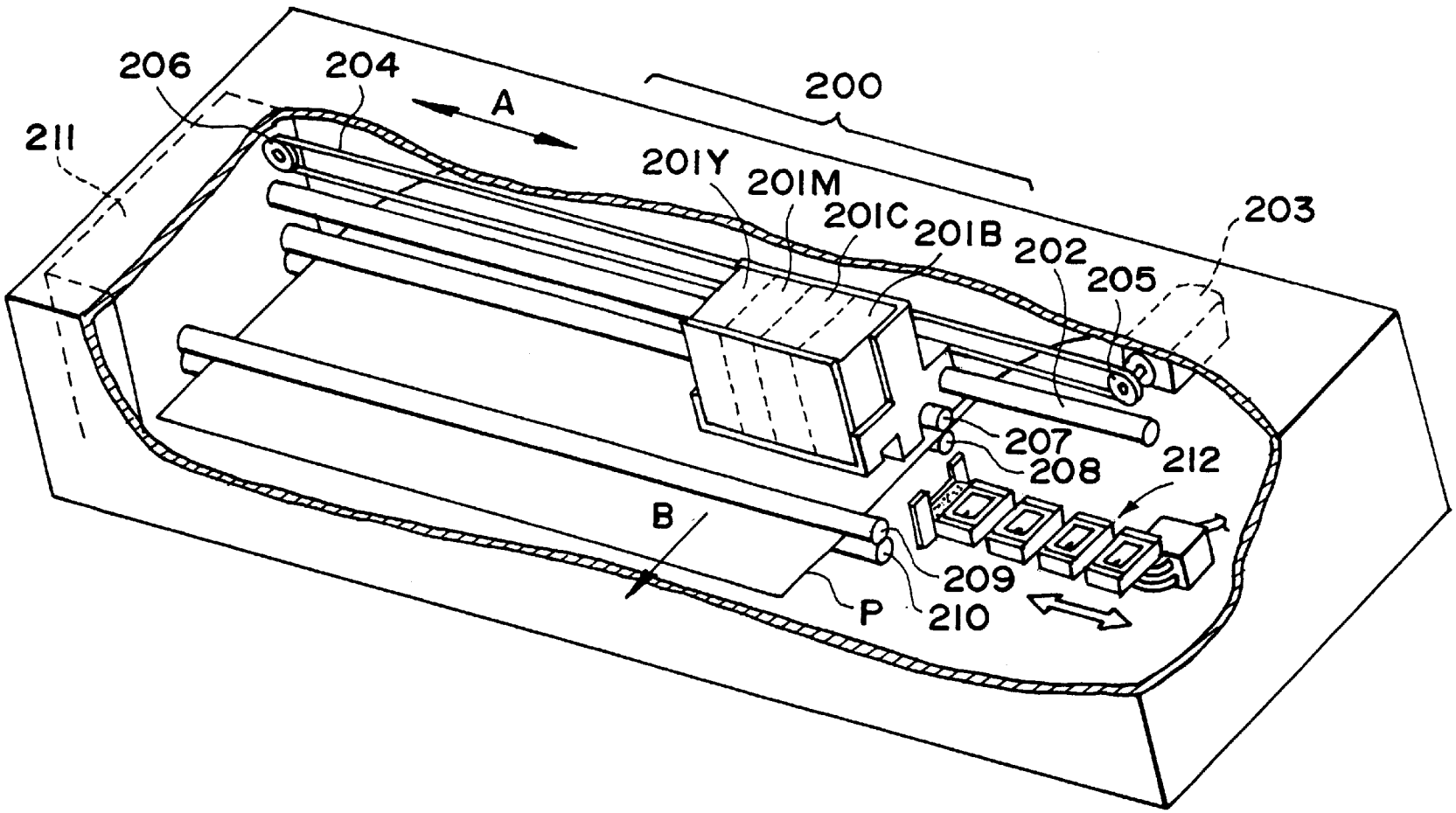
FIG. 6 is a perspective view of a liquid ejection apparatus in which the desirable liquid ejection head compatible with the liquid ejection method in accordance with the present invention can be mounted.

Referring to FIG. 6, a reference character 200 designates a carriage on which the above-described liquid ejection head is removably mounted. In the case of this liquid ejection apparatus, four liquid ejection heads of four different colors are mounted on the carriage 200. They are mounted on the carriage 200 together with corresponding ink containers: a yellow ink container 201Y, a magenta ink container 201M, a cyan ink container 201C, and a black ink container 201B.

The carriage 200 is supported by a guide shaft 202, and is caused to shuttle on the guide shaft 202 in the directions indicated by arrows A by an endless belt 204 driven back and forth by a motor 203. The endless belt is stretched around pulleys 205 and 206.

A sheet of recording paper P as a recording medium is intermittently conveyed in the direction indicated by arrow B perpendicular to the direction A. The recording paper P is held, being pinched, by a pair of rollers 207 and 208, on the upstream side, in terms of the direction in which the recording paper P is intermittenly conveyed, and another pair of rollers 209 and 210, on the downstream side, and is conveyed, being given a certain amount of tension, so that it remains flat across the area which faces the head. Each of the two pairs of rollers are driven by a driving section 211, although the apparatus may be designed so that they are driven by the aforementioned driving motor.

At the beginning of a recording operation, the carriage 200 is at the home position. Even during a recording operation, it returns to the home position and remains there if required. At the home position, capping members 212 are provided, which cap corresponding ejection orifices. The capping members 212 are connected to performance restoration suction means (unillustrated) which suctions liquid through the ejection orifices to prevent the ejection holes from being clogged.

While the present invention has been described as to what is currently considered to be the preferred embodiments, it is to be understood that the invention is not limited to them. To the contrary, the invention is intended to cover various modifications and equivalent arrangements within the spirit and scope of the appended claims. The scope of the following claims is to be accorded the broadest interpretation so as to encompass all such modifications and equivalent structures and functions.

What is claimed is:

1. A liquid ejection method comprising:

a step of preparing a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on a bottom side thereof; and a step of applying the thermal energy to the liquid to cause the liquid to undergo a change of state to create a bubble, wherein the liquid is ejected through the ejection outlet by pressure of the bubble, wherein the bubble is first in communication with ambience during reduction of the volume of the bubble after the bubble reaches a maximum volume, and the bubble communicates with the ambience at a position closer to the electrothermal transducer element than to the ejection outlet.

2. A liquid ejection head method comprising:

a step of preparing a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on a bottom side thereof;

a step of forming a bubble in the liquid contacting the electrothermal transducer element in the liquid flow path to displace the liquid away from the electrothermal transducer element;

a step of communicating the bubble with ambience to introduce the ambience into the liquid flow path;

a step, after said communication step, of a first portion of the liquid returning to the electrothermal transducer element; and a step of separating a second portion of the liquid into a droplet of the liquid after said communication step.

3. A liquid ejection method comprising:

a step of preparing a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on a bottom side thereof; and a step of generating a bubble in the liquid in the liquid flow path, wherein the bubble communicates with ambience, and the ambience is introduced into the liquid flow path, and the liquid is separated into a liquid droplet while covering the electrothermal transducer element after the bubble communicates with the ambience.

4. A liquid ejection method comprising:

a step of preparing a liquid ejection head including an electrothermal transducer clement for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer clement on a bottom side thereof; and a step of generating a bubble in the liquid in the liquid flow path, wherein the bubble is brought into communication with ambience when the bubble is decreasing in volume, and the liquid is ejected, wherein the bubble communicates with the ambience at a position closer to the electrothermal transducer element than to the ejection outlet.

5. A method according to claim 1, 2, 3 or 4, wherein the ejection outlet is formed in an ejection outlet plate.

6. A method according to claim 5, wherein the ejection outlet is tapered such that an area of an opening in the ejection outlet plate at an upper side thereof is smaller than an open area in the ejection outlet plate at a lower side thereof.

7. A method according to claim 1, 2, 3, or 4, wherein the ejection outlet is circular in shape.

8. A method according to claim 1, 2, 3, or 4, wherein the ejection outlet is rectangular in shape.

9. A method according to any one of claims 1–4, wherein the liquid is separated at a position adjacent to a center of the electrothermal transducer element.

10. A method according to any one of claims 1–4, wherein the liquid is separated at a position closer to the electrothermal transducer element than the ejection outlet.

11. A method according to any one of claims 1–4, wherein the electrothermal transducer element causes an abrupt temperature rise beyond a nucleate boiling point to generate a bubble contributable to the bubble in the liquid flow path utilized to eject the liquid.

12. A method according to claim 2 or 3, wherein the bubble communicates with the ambience at a position closer to the electrothermal transducer clement than to the ejection outlet.

13. A liquid ejection apparatus comprising:

a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on a bottom side thereof; and circuitry for applying the thermal energy to the liquid to cause the liquid to undergo a change of state to create a bubble, wherein the liquid is ejected through the ejection outlet by pressure of the bubble, wherein the bubble is first in communication with ambience during reduction of the volume of the bubble after the bubble reaches a maximum volume, and the bubble communicates with the ambience at a position closer to the electrothermal transducer element than to the ejection outlet.

14. A liquid ejection apparatus comprising:

a liquid ejection head including an electrothermal transducer element for generating thermal energy contributable to ejection of liquid, an ejection outlet for ejecting the liquid, the ejection outlet being provided at a position opposed to the electrothermal transducer element, and a liquid flow path in fluid communication with the ejection outlet to supply the liquid to the ejection outlet and having the electrothermal transducer element on a bottom side thereof; and circuitry for applying energy to the electrothermal transducer element to form a bubble in the liquid contacting the electrothermal transducer element in the liquid flow path to displace the liquid away from the electrothermal transducer element, the bubble communicating with ambience to introduce the ambience into the liquid flow path, the liquid subsequently returning to the electrothermal transducer element, and a portion of the liquid separating into a liquid droplet after the bubble communicates with the ambience.

15. An apparatus according to claim 14, wherein the liquid is separated into the liquid droplet while covering the electrothermal transducer element.

16. An apparatus according to claim 14, wherein the bubble is brought into communication with ambience when the bubble is decreasing in volume.

17. An apparatus according to any one of claims 13–16, wherein the ejection outlet is formed in an ejection outlet plate.

18. An apparatus according to claim 17, wherein the ejection outlet is tapered such that an area of an opening in the ejection outlet plate at an upper side thereof is smaller than an open area in the ejection outlet plate at a lower side thereof.

19. An apparatus according to any one of claims 13–16, wherein the ejection outlet is circular in shape.

20. An apparatus according to any one of claims 13–16, wherein the ejection outlet is rectangular in shape.

21. An apparatus according to any one of claims 14–16, wherein the bubble communicates with the ambience at a position closer to the electrothermal transducer element than to the ejection outlet.

22. An apparatus according to any one of claims 13–16, wherein the liquid is separated at a position adjacent to a center of the electrothermal transducer element.

23. An apparatus according to any one of claims 13–16, wherein the liquid is separated at a position closer to the electrothermal transducer clement than to the ejection outlet.

24. An apparatus according to any one of claims 13–16, wherein the electrothermal transducer element causes an abrupt temperature rise beyond a nucleate boiling point to generate a bubble contributable to the bubble in the liquid flow path utilized to eject the liquid.

* * * * *

UNITED STATES PATENT AND TRADEMARK OFFICE

CERTIFICATE OF CORRECTION

PATENT NO. : 6,354,698 B1
DATED : March 12, 2002
INVENTOR(S) : Tachihara et al.

It is certified that error appears in the above-identified patent and that said Letters Patent is hereby corrected as shown below:

Column 1,
Line 12, "No." should read -- Nos. --.

Column 10,
Lines 14 and 15, "4.
Further" should read -- 4. Further --.

Column 17,
Lines 29 and 36, "clement" should read -- element --.

Column 18,
Line 3, "clement" should read -- element --.

Column 20,
Line 3, "clement" should read -- element --.

Signed and Sealed this

Fourth Day of June, 2002

*Attest:*

*Attesting Officer*

JAMES E. ROGAN
*Director of the United States Patent and Trademark Office*